US005694862A

United States Patent [19]

Grubb

[11] Patent Number: 5,694,862

[45] Date of Patent: Dec. 9, 1997

[54] CORNER DESK HUTCH UNIT

[75] Inventor: Jeffrey A. Grubb, Anaheim, Calif.

[73] Assignee: The Orman Grubb Co., Anaheim, Calif.

[21] Appl. No.: 588,647

[22] Filed: Jan. 19, 1996

[51] Int. Cl.[6] ..... A47B 35/00

[52] U.S. Cl. ..... 108/50; 108/90; 312/196

[58] Field of Search ..... 108/50, 42, 90, 108/182; 312/196

[56] References Cited

U.S. PATENT DOCUMENTS

| | | | |
|---|---|---|---|
| 688,105 | 12/1901 | Lohrman | 312/196 X |
| 1,247,590 | 11/1917 | Sprung | 312/196 X |
| 3,325,233 | 6/1967 | Oppenhuizen et al. | 312/196 X |
| 4,905,609 | 3/1990 | Haskins | 312/196 X |
| 4,974,915 | 12/1990 | Bussard | 108/50 X |
| 5,130,494 | 7/1992 | Simonton et al. | 108/50 X |
| 5,220,871 | 6/1993 | Grund et al. | 108/50 |
| 5,522,324 | 6/1996 | Van Gelder et al. | 108/50 |
| 5,546,873 | 8/1996 | Conner et al. | 108/50 X |

*Primary Examiner*—Jose V. Chen

*Attorney, Agent, or Firm*—Knobbe, Martens, Olson & Bear, LLP

[57] ABSTRACT

A shelf unit to be used on top of a corner desk group comprises a pair of hutches and a bridge member positioned between the hutches. The hutches have outer support legs orthogonal to their rear walls and inner support legs parallel to their rear walls. The position of the inner support legs of the hutches and the overhead bridge member or shelf provide a stable configuration with increased working space on the top of the desk group. Thus, a typewriter or personal computer may be placed on the corner or middle section of the desk group with unobstructed access to the left and right sides of the typewriter or computer.

17 Claims, 3 Drawing Sheets

CORNER DESK HUTCH UNIT

BACKGROUND OF THE INVENTION

The present invention relates to shelf units, and, in particular, to a hutch unit for use over a corner desk group.

Corner desk arrangements are used in both home and business offices in order to provide an increased working area which is still within about an arm's reach for the worker. Corner desks are also convenient for rooms or areas which are small and/or do not allow much option in the placement of the furniture due to the presence of a window or other structural element. These corner desks typically have two or three pieces generally forming an "L" shape.

Hutches or desk-top shelf units, typically having open shelves and cabinets, are often used with the corner desks for added storage convenience. A pair of hutches are typically placed atop the leftmost and rightmost desk portions, maintaining an open space above the middle or corner desk portion. It is popular to place a personal computer on top of the corner portion of the desk top so that there is no obstruction in the upward direction by a hutch. However, the bottom supports of the hutches which are nearest the corner desk portion extend closely to the sides of the computer, thereby restricting the working space around the computer and creating a barrier to materials on the desk top below the hutches.

SUMMARY OF THE INVENTION

A desk-top shelf unit of the present invention is for use on top of a corner desk and comprises a pair of hutches and a bridge member positioned between the hutches and above the desk. The hutches preferably have outer support legs orthogonal to their rear walls and inner support legs parallel to their rear walls. The overhead bridge member and the position of the inner support legs of the hutches provide a stable configuration with increased working space on the top of the desk. Thus, a typewriter or personal computer may be placed on the corner or middle section of the desk with unobstructed access to the left and right sides of the typewriter or computer and also to materials across the top of the desk.

In one aspect of the present invention, the shelf unit is for use on a top of a corner desk comprising left, middle and right desk sections, formed by any combination of desk pieces, wherein the shelf unit is not attached to any wall. The shelf unit comprises a pair of hutches, each of the hutches comprising: a vertical wall terminating a distance above the desk; a horizontal member adjacent said vertical wall; and a vertical support contacting the desk distally from the middle desk section.

The shelf unit further comprises a bridge having left and right portions connecting to the hutches. The bridge provides opposing force on the hutches to prevent their fall. The bridge spans the space over the middle desk section between the vertical walls of the hutches such that an increased working space is provided on the top of the desk from the far left to far right of the desk.

Preferably, each of the hutches further comprises another support substantially orthogonal to and substantially below the vertical wall. Most preferably, ledges extend from the vertical walls and provide support under the left and right portions of the bridge. A lower end of the parallel support preferably at least partially contacts the middle desk section. In alternative embodiments, the parallel support may have a front surface having holders for articles used at the corner desk, such as floppy disks for use with a personal computer placed atop the middle desk section.

In the preferred embodiments, the lower ends of the supports of the hutches are fastened to the desk sections. Also, it is preferred that the left and right portions of the bridge are fastened to the vertical walls; although, alternatively, the bridge may be fastened to the ledges of the hutches.

In the preferred embodiments, the bridge comprises a shelf extending over the middle desk section and shaped to fit in the corner space. Further, the bridge preferably has a front member having cork material for posting pieces of paper or such. In addition, a light unit may be mounted under the bridge for illuminating a top surface of the middle desk section.

Further advantages and applications will become apparent to those skilled in the art from the following detailed description and the drawings referenced herein.

DETAILED DESCRIPTION OF THE PREFERRED EMBODIMENTS

Figure 1:
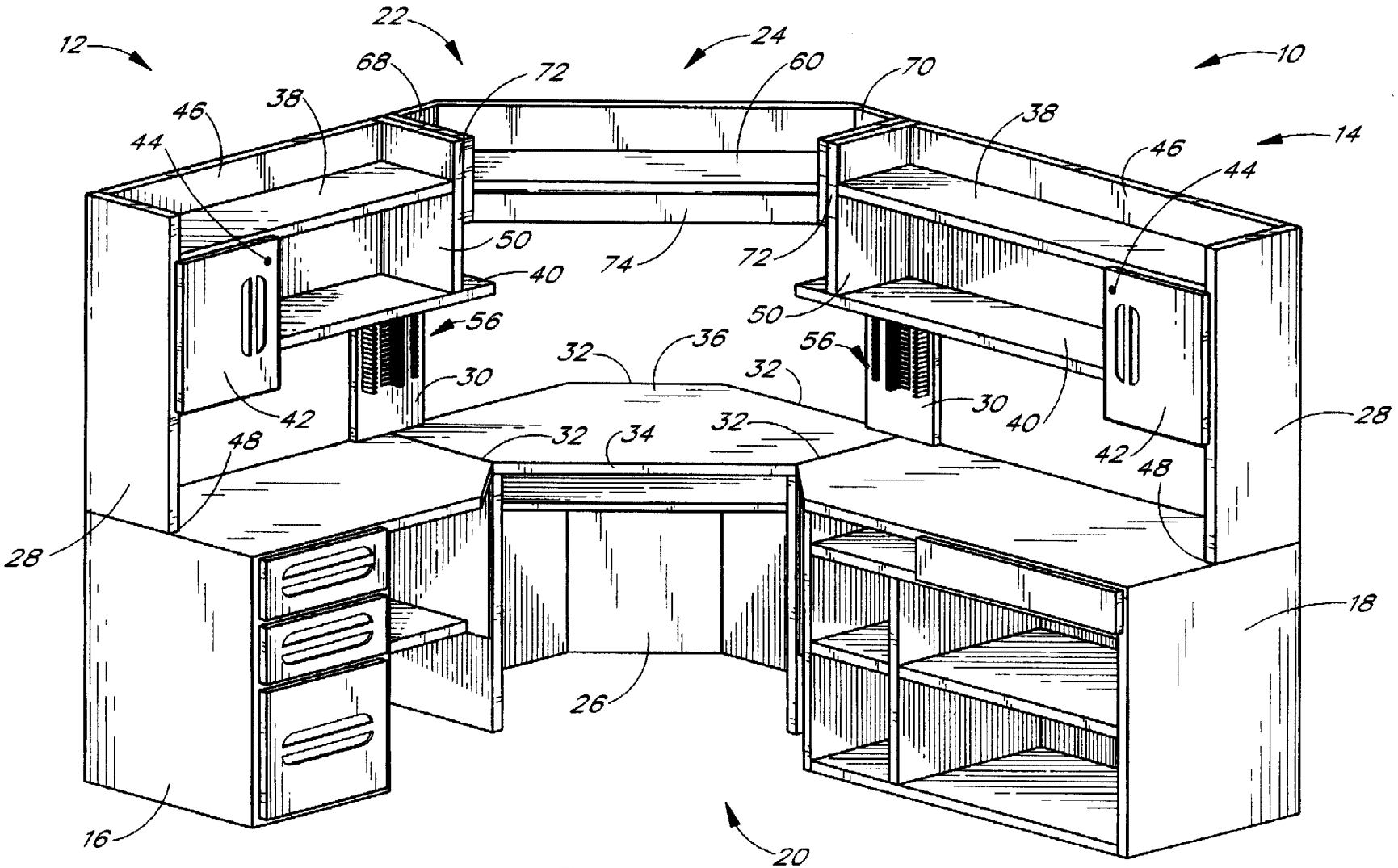
FIG. 1 is a perspective view of a preferred embodiment of a shelf unit of the present invention as used on top of a corner desk group.

A preferred embodiment of a shelf unit constructed in accordance with the present invention is illustrated in FIG. 1 and generally referenced by the numeral 10. The unit 10 generally comprises a pair of hutches 12, 14 which are placed on top of left and right sections 16, 18 of a corner desk 20. A bridge member 22 of the unit 10 spans a space 24 between the two hutches, over a middle desk section 26. Support of each hutch 12, 14 atop the desk 20 is provided by an outer and an inner member 28, 30, wherein the outer member 28 is distal to the middle desk section 26 and the inner member 30 is proximal to the middle desk section 26. Further support to prevent the hutch 12, 14 from falling forward is provided by the bridge member 22, acting as a brace between the left and right hutches 12, 14.

Although the corner desk 20 is shown as comprising three separate pieces, the left and middle sections 16, 26, or the right and middle sections 18, 26, may be combined in alternative embodiments to form two pieces comprising the corner desk 20. The left and right sections 16, 18 of the corner desk 20 may be similar in dimensions, or one section may be longer than the other, as desired. Also, the number and arrangement of the desk drawers and shelves are understood to be of any conventional type. Further, the middle desk section 26 may have right angles at each corner in place of corners 32 with the obtuse angles, as shown in FIG. 1 at a front 34 and rear 36 of the middle desk section 26.

Figure 2:
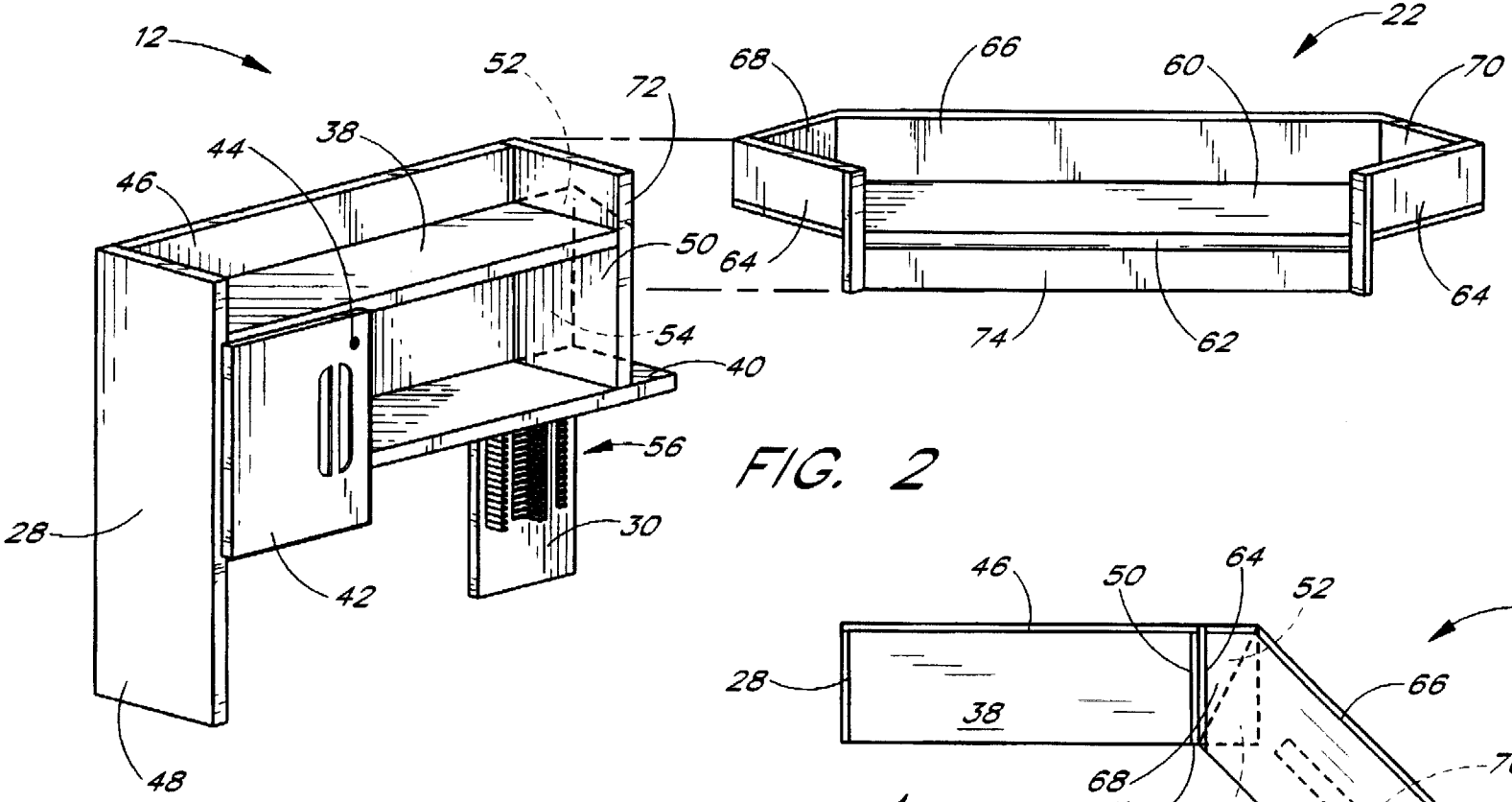
FIG. 2 is an exploded perspective view of one hutch and a bridge member illustrating the mating ledge and bridge portions.
Figure 3:
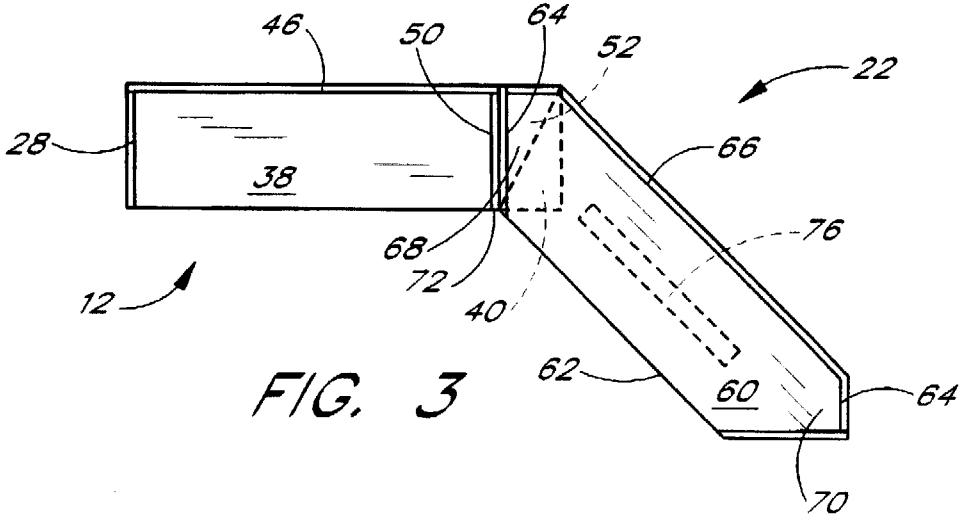
FIG. 3 is a top plan view of the mated hutch and bridge member.

Referring now to the preferred embodiment of FIGS. 2 and 3, a hutch 12 for the left side of the corner desk 20 is shown with the bridge member 22. It is understood, however, that the right hutch 14 has similar features and will not be described further. The hutch 12 is preferably formed from wood, such as oak, although it may also be constructed from steel, particle board or other suitable materials known to those skilled in the art and most preferably matches the desk 20. Preferably, the hutch 12 includes an upper and a lower shelf 38, 40 as well as a cabinet 42, and is of a conventional construction known to those skilled in the art. The cabinet 42 may, for example, include a conventional lock mechanism 44 for security. In alternative embodiments, the hutch 12 may comprise more or fewer shelves and cabinets arranged in various combinations, as desired. The outer support member 28, distal to the middle desk section 26, is substantially orthogonal to a rear wall 46 of the hutch 12. The rear wall 46 may partially or completely cover the back of the hutch 12. A lower end 48 of the outer member 28 is preferably fastened to the desk top using nails (not shown); although, other suitable fastening methods known to those skilled in the art may alternatively be used.

A wall 50 proximal to the middle desk section 26 and also substantially orthogonal to the rear of the hutch 12 has a ledge 52 extending therefrom. The ledge 52 is preferably triangular in shape; however, it is understood that other shapes, such as a rectangle, may alternatively be used in the present invention. The ledge 52 extends from the proximal wall 50 toward the space 24 over the middle desk section 26 and is preferably partly supported by a wall section 54 toward the rear of the hutch 12. The ledge 52 may be attached to the proximal wall 50 by nails or other suitable fasteners, or the ledge 52 may be fastened to one or more brackets which are in turn fastened to the wall 50. Alternatively, a flange or bracket (not shown) may be provided on the wall 50 in place of the ledge 52.

In the preferred embodiment of the hutch 12, an inner support member 30 is provided generally below the proximal wall 50 and the ledge 52. It is preferred that the wall 50 be positioned over substantially the middle of the inner member 30. The inner member 30 is substantially parallel to the rear wall 46 of the hutch 12, and is preferably positioned substantially at the rear of the hutch 12. Accessories such as holders 56 for computer diskettes or floppy disks may be mounted to the front of the inner member 30. The inner member 30 is also preferably attached to the desk 20 using nails (not shown); although, any conventional fasteners, such as screws or dowels, may also be used.

It is preferred that the inner and outer support members 30, 28 are attached to the top of the desk 20 in case of an earthquake or accident in which forces are applied which may push the hutch 12 off the desk top, causing injury to someone or damage to the hutch and its contents. Although the support members 28, 30 are shown to comprise substantially vertical walls or panels, in alternative embodiments one or both of the supports of the hutches 12, 14 may comprise posts or brackets (not shown) known to those skilled in the art. Further, it is contemplated that the inner support member 30 may be removed so long as the bridge member 22 adequately supports the hutches near the middle desk section 26.

The preferred embodiment of the bridge member 22 comprises an overhead shelf 60 having an open front 62 with sides 64 and a back 66 surrounding the remainder of the perimeter. Left and right end portions 68, 70 of the member 22 are shaped to fit onto the ledges 52 of the hutches 12, 14 and closely against the proximal walls 50. Preferably, the hutches 12, 14 and bridge member 22 are sized and connected so that they form a shelf unit extending across the entirety of the top of the desk 20.

The bridge member 22 is preferably attached by screws (not shown) extending through holes 78 in the sides of the end portions 68, 80 and through the proximal walls 50. Other fastening methods may alternatively be used to attach the bridge member 22 to the hutches 12, 14 so that contact is maintained therebetween. In this manner an opposing force by the bridge member 22 is always present to prevent the hutches 12, 14 from falling forward and downward. In alternative embodiments, the bridge member 22 may comprise a relatively narrow bar or beam, so long as a bracing force is applied to the hutches 12, 14 at or near edges 72 closest to the front 34 of the middle desk section 26 yet above the head of a person seated at the middle desk section.

Figure 4:
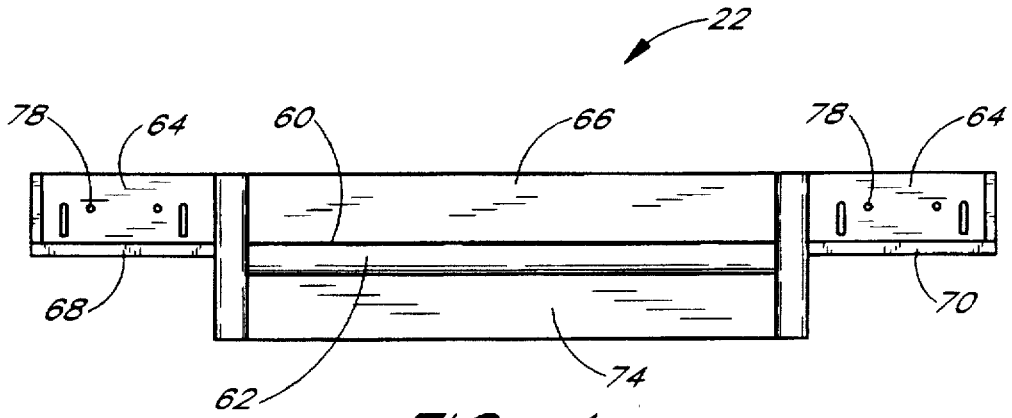
FIG. 4 is a front elevational view of a preferred embodiment of a bridge member.
Figure 5:
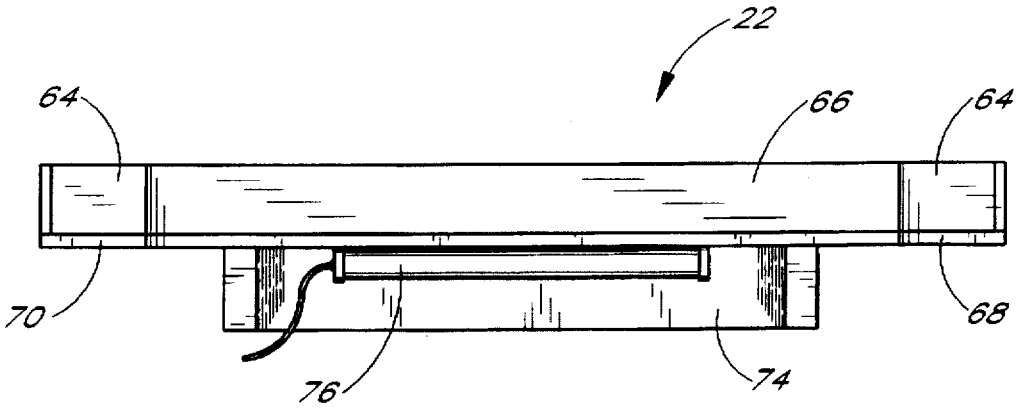
FIG. 5 is a rear elevational view of the bridge member of FIG. 4.

As shown in FIGS. 4 and 5, the bridge member 22 may optionally have features which add to the convenience of the person using the corner desk 20. That is, a panel 74 located below the front 62 of the shelf 60 may have cork material, for example, onto which notes, photographs, or other such items may be attached using pins. Or, a decorative panel or nameplate (not shown) may be attached at the front 62 of the bridge member 22, as desired. Also, a fluorescent light unit 76, for example, of conventional construction may be mounted under the shelf 60 for illumination of the middle desk section 26 and any materials situated thereon. In addition, hooks, brackets or folding book or paper holders (not shown) known to those skilled in the art may be attached to the underside of the bridge member 22 or to the facing side of the proximal walls 50. These additional features may be used to hang various work articles or decorations above the middle desk section 26.

Figure 6:
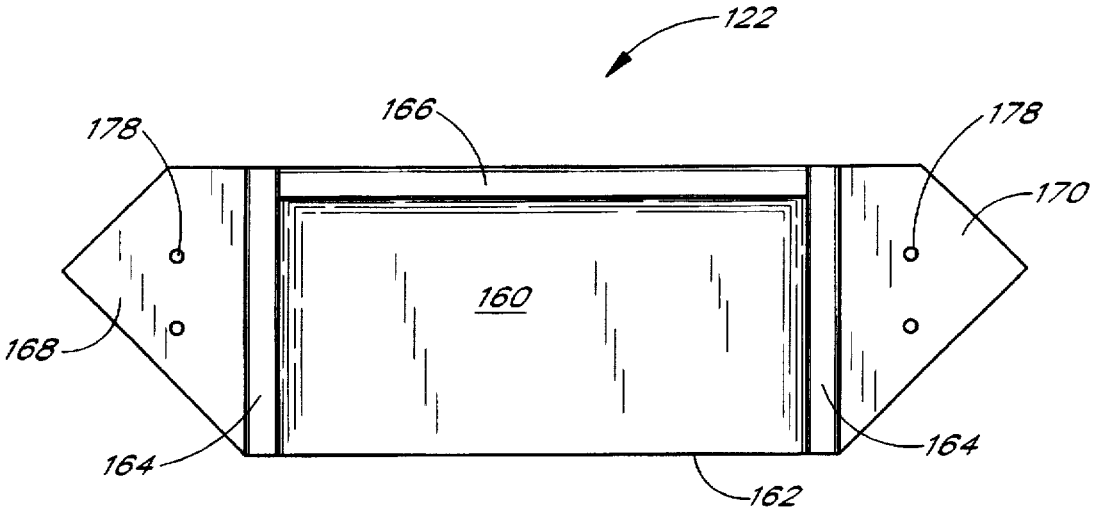
FIG. 6 is a top plan view of an alternative embodiment of a bridge member.

An alternative embodiment of a bridge member 122 of the present invention is shown in FIG. 6, wherein left and right end portions 168, 170 are attached to the ledges 52 of the hutches 12, 14. Preferably, screws (not shown) extend through holes 178 in the end portions 168, 170 for attachment of the bridge member 122 to the ledges 52. A front 162 of the bridge member 122 is open for access to a shelf area 160, and sides 164 partition the shelf area 160 from the end portions 168, 170. It is readily understood that an open shelf may be formed by the bridge member without any sides or vertical portions; alternatively, the bridge member may comprise an overhead drawer or cabinet.

Thus, in the present invention, the overhead bridge member and the position of the preferred inner support legs of the hutches provide a stable configuration with increased working space on the top of the corner desk. A personal computer or other equipment may be placed on the corner or middle section of the desk with unobstructed access to the left and right sides to reach materials substantially across the entire top of the desk.

The embodiments illustrated and described above are provided merely as examples of the corner desk hutch unit of the present invention. Other changes and modifications can be made from the embodiments presented herein by those skilled in the art without departure from the spirit and scope of the invention, as defined by the appended claims.

What is claimed is:

1. A shelf unit for use on a top of a corner desk comprising left, middle and right desk sections, said left and right desk sections positioned substantially orthogonal to each other, said middle desk section adapted to fit in a corner space between said left and right desk sections, said shelf unit not attached to any wall, said shelf unit comprising:

a first and second hutch for positioning substantially orthogonal to each other, each of said hutches comprising:

a vertical wall;

a horizontal member having one end attached to said vertical wall; and a vertical support extending beneath another end of said horizontal member, said support extending lower than said vertical wall; and a bridge having left and right portions connected to said hutches, said bridge providing opposing force on said hutches to prevent their fall and eliminating the need for additional vertical supports extending below said horizontal members and obstructing the space below said vertical walls, said shelf unit in use with said corner desk having said bridge diagonally spanning an open space over said middle desk section between said vertical walls of said hutches, said bridge and said hutches thereby providing an increased working space on the top of said corner desk.

2. The shelf unit of claim 1, wherein in use on top of said corner desk said vertical wall of each of said hutches has a ledge extending therefrom toward said open space over said middle desk section, said left and right portions of said bridge positioned on top of said ledges.

3. The shelf unit of claim 2, wherein said left and right portions of said bridge are fastened to said ledges of said hutches.

4. The shelf unit of claim 1, wherein each of said hutches further comprises a support extending substantially below and substantially orthogonal to said vertical wall.

5. The shelf unit of claim 4, wherein in use on top of said corner desk said orthogonal support at least partially contacts said middle desk section.

6. The shelf unit of claim 4, wherein said orthogonal support has a holder mounted thereon for articles used at said corner desk.

7. The shelf unit of claim 1, wherein in use on top of said corner desk said supports of said hutches are fastened to said left and right desk sections.

8. The shelf unit of claim 1, wherein said left and right portions of said bridge are fastened to said vertical walls of said hutches.

9. The shelf unit of claim 1, wherein in use on top of said corner desk said bridge comprises a shelf extending over said middle desk section and adapted to fit in said corner space between said left and right desk sections.

10. The shelf unit of claim 9, wherein said bridge has a front member having cork material for posting pieces of paper.

11. The shelf unit of claim 9, wherein said shelf has a light unit mounted thereunder for illuminating a top surface of said middle desk section.

12. A shelf unit for use on a top of a corner desk comprising left, middle and right desk sections, said left and right desk sections positioned substantially orthogonal to each other, said middle desk section adapted to fit in a corner space between said left and right desk sections, said shelf unit not attached to any wall, said shelf unit comprising:

a first and second hutch substantially orthogonal to each other, each of said hutches comprising:

a vertical rear wall;

first and second side walls attached to said rear wall and extending forwardly substantially orthogonal to said rear wall;

a shelf positioned between said first and second side walls on a first side of said first side wall;

a ledge extending from a second side of said first side wall opposite said shelf;

a first vertical support attached to and extending substantially orthogonal to said rear wall, said first support extending lower than said first side wall; and a second vertical support extending substantially parallel to and adjacent said rear wall, said second support positioned substantially below said first side wall; and a bridge extending between said hutches and positioned on said ledges to prevent their fall such that no additional support for said shelf unit which would obstruct the space below said first side walls is required, such that when said shelf unit is positioned on top of said corner desk there is provided an increased working space across the top of said corner desk.

13. A corner desk and hutch unit for use in a corner space, said unit comprising:

a corner desk having, left, middle and right desk sections, said left and right desk sections positioned substantially orthogonal to each other, said middle desk section adapted to fit in said corner space between said left and right desk sections;

a first and second hutch for positioning on the top of said corner desk substantially orthogonal to each other and substantially over said left and right desk sections, each of said hutches comprising:

a vertical wall terminating a distance above said corner desk;

a horizontal member attached to said vertical wall and spaced above said corner desk; and a vertical support attached to said horizontal member and contacting said corner desk distally from said middle desk section; and a bridge having left and right portions connected to said hutches, said bridge providing opposing force on said hutches to prevent their fall and eliminating the need for additional vertical support members extending below said horizontal members and across the top of said corner desk, said bridge spanning an open space above said middle desk section between said vertical walls of said hutches, said bridge thereby providing an increased working space on the top of said corner desk.

14. A self-standing shelf assembly not attached to any wall, said shelf assembly comprising:

a first and second hutch for positioning at an angle to each other, each of said hutches comprising:

a vertical rear wall;

inside and outside walls attached to said rear wall and extending forwardly substantially orthogonal to said rear wall;

a shelf attached between said inside and outside walls and at a first side of said inside wall;

a ledge formed on a second side of said inside wall opposite said shelf; and a vertical support extending below said shelf and substantially orthogonal to said rear wall, said vertical support substantially closer to said outside wall than said inside wall; and a bridge diagonally extending between said hutches and positioned on said ledges above said vertical supports, no additional support for said shelf assembly being required to maintain an upright position of said shelf assembly.

15. The shelf assembly of claim 14, wherein said bridge has left and right portions fastened to said ledges of said hutches.

16. The shelf assembly of claim 14, wherein said bridge has left and right portions fastened to said inside walls of said hutches.

17. A self-standing shelf assembly adapted to fit in a corner space and not attached to any wall, said shelf assembly comprising:

a first and second hutch for positioning at an angle to each other, each of said hutches comprising:

a vertical rear wall;

inside and outside walls attached to said rear wall and extending forwardly substantially orthogonal to said rear wall;

a shelf attached between said inside and outside walls;

a first vertical support extending below said shelf and substantially orthogonal to said rear wall, said first support substantially below said outside wall; and a second vertical support extending below said shelf and substantially coplanar with said rear wall, said second support substantially below said inside wall; and a bridge extending between said hutches and above said second support, said bridge secured to said inside walls of said hutches, no additional vertical supports for said shelf assembly being required to maintain an upright position of said shelf assembly.

* * * * *